United States Patent [19]

Hill

[11] 3,994,224

[45] Nov. 30, 1976

[54] MOUNTING STRUCTURE FOR PRINTING PLATES

[75] Inventor: George B. Hill, Salt Lake City, Utah

[73] Assignee: Newspaper Equipment Company, Salt Lake City, Utah

[22] Filed: June 9, 1975

[21] Appl. No.: 585,127

[52] U.S. Cl. ..... 101/415.1; 101/407 BP

[51] Int. Cl.[2] ..... B41F 27/06

[58] Field of Search ..... 101/415.1, 378

[56] References Cited

UNITED STATES PATENTS

| | | | |
|---|---|---|---|
| 2,386,214 | 10/1945 | Harrold et al. | 101/415.1 |
| 2,387,332 | 10/1945 | Kunz | 101/365 |
| 2,621,592 | 12/1952 | Farber | 101/415.1 |
| 3,017,830 | 1/1962 | Penner | 101/415.1 |
| 3,533,355 | 10/1970 | Wall | 101/415.1 |
| 3,696,744 | 10/1972 | Etchell | 101/415.1 |
| 3,766,857 | 10/1973 | Schlatter | 101/415.1 |
| 3,791,295 | 2/1974 | Albright | 101/415.1 |
| 3,858,511 | 1/1975 | Moyer | 101/415.1 |
| 3,874,292 | 4/1975 | Parsley | 101/415.1 |
| 3,896,728 | 7/1975 | Nakagawa | 101/415.1 |
| 3,903,796 | 9/1975 | Jeschke et al. | 101/415.1 |

*Primary Examiner*—Edgar S. Burr
*Assistant Examiner*—Paul J. Hirsch

[57] ABSTRACT

Press cylinder structure for securing a printing plate over the cylinder's saddle. This saddle includes a first longitudinal edge permissably provided with a printing plate retainer bar, and the opposite edge of the saddle being spaced from an independent, movable, tensioned, printing-plate locking bar. Such locking bar is spring-loaded relative to the saddle, and is provided with registry orientation means. The locking bar is movable inwardly toward the saddle so as to facilitate printing plate, edge mounting onto the locking bar. Thereafter, the locking bar is urgeable outwardly with respect to the saddle so that tension may be applied to the plate. In the inward progress of the locking bar relative to the saddle, means are provided for releasably fixing the disposition of the locking bar relative to the press cylinder so that a printing plate disposed on the saddle and engagement thereof by the locking bar can be released.

15 Claims, 12 Drawing Figures

MOUNTING STRUCTURE FOR PRINTING PLATES

The present invention relates to printing press cylinders of drums and, more particularly, to new and improved structure for securing a printing plate over the saddle thereof such that the saddle will not have to be replaced frequently.

Roller-type newspaper presses incorporate a series of elongate cylinders to which printing plates are attached. At first, cast lead printing saddles were mounted to the cylinder. Then magnesium or zinc plates were affixed over raised, aluminum, backing saddles, and bore the designs or letters desired. In recent years there has been developed the concept of using raised saddles on such printing cylinders, with low-cost plastic plates or metal-backed plastic plates being employed over such saddles.

Currently, saddles are generally made of aluminum and are machined to very close tolerances, thus being expensive. These saddles self-contain printing-plate lock-up mechanisms which, if damaged or malfunctioning, requires the replacement of the entire saddle. This is an expensive procedure. Also, current cylinder designs require cylinder rotation during printing-plate replacement.

In the present invention, a Z-configured retainer bar is employed by the saddle to secure one turned-back end of a printing plate. The plate stretches over the saddle and is secured along its upper edge or margin by a spring-biased locking bar that is independent of the saddle, and is laterally displaceable over a small arc upon the outer cylinder surface of the cylinder. The locking bar can be spring-loaded relative to the upper edge of the saddle, however, and this may be accomplished by compression spring, leaf-sring, elastomeric, or other resilient means tending to urge the locking bar outwardly relative to the saddle. In respective embodiments of the invention, alternate means are provided for retaining the locking bar inwardly, in a releasably fixed relationship relative to the saddle, when the printing plate used, formerly taut, is now loosened for removal. Manually operable means are provided for releasing the locked position of the locking bar so that the same may be urged outwardly by the aforementioned resilient means, to thereby tension a printing plate for subsequent use.

The invention is believed ideally suited to the present concept of employing plastic or metal-backed plastic plates, utilizing the same on the same elongate drum for plural runs of given printed matter. Saddles, thus, may be preserved in their integral or clamped condition relative to the cylinder and will require replacement only very infrequently.

Accordingly, a principal object of the present invention is to provide suitable structure for locking a printing plate over a press cylinder saddle, not requiring cylinder rotation.

A further object is to provide, in a press cylinder construction incorporating a raised saddle, a lock-up structure which is independent of the saddle, for releasably tensioning a replaceable printing plate disposed over such saddle.

A further object is to provide in a press cylinder construction, incorporating a saddle, a spring loaded locking bar suitable for tensioning a printing plate disposed over such saddle and capable of being releasably locked inwardly, to provide for printing plate release.

A further object is to provide, in a saddle-including press cylinder, a spring-biased printing-plate locking bar laterally movable with respect to a longitudinal edge of the saddle and constructed for mounting a printing plate edge in place.

A further object is to provide structures for securing under tension the opposite, longitudinal edges of a replaceable printing plate on press cylinder, which structures include means for maintaining in taut condition such printing plate, and also for permitting removal of tension thereon preparatory to plate replacement.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

Figure 1:
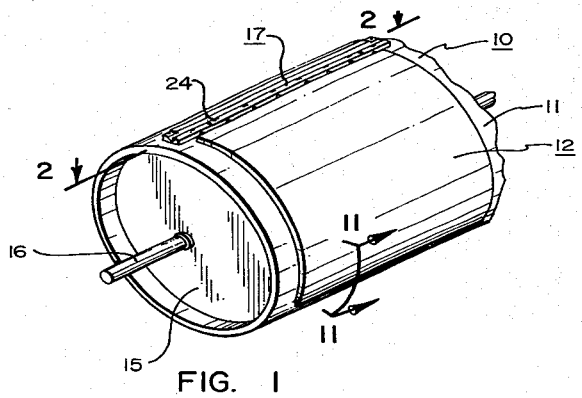
FIG. 1 is a perspective view of a newspaper type printing press cylinder as shown in fragmentary view.

In FIG. 1 the newspaper press cylinder or drum 10 includes a cylinder member 11 to which a saddle 12 is clamped, bolted or otherwise secured. The manner of securement of the saddle to the cylinder 10 is strictly conventional, may take one of several forms, and one form is shown by virtue of the inclusion of locking shaft 13 and cam hook 14 keyed thereto in a manner illustrated in FIG. 4. The particular means by which a representative saddle 12 is secured to press cylinder 10 forms no part of the invention. It will also be understood that a saddle 12 will be disposed on the opposite side of cylinder member 11, but is not shown in FIG. 1, for convenience of illustration.

Cylinder member 10 may include closed ends 15 which provide a keyed connection to axial central shaft 16. This shaft will be journaled in press structure in a conventional manner. The journaling and/or driving thereof forms no part of the present invention.

Figure 2:
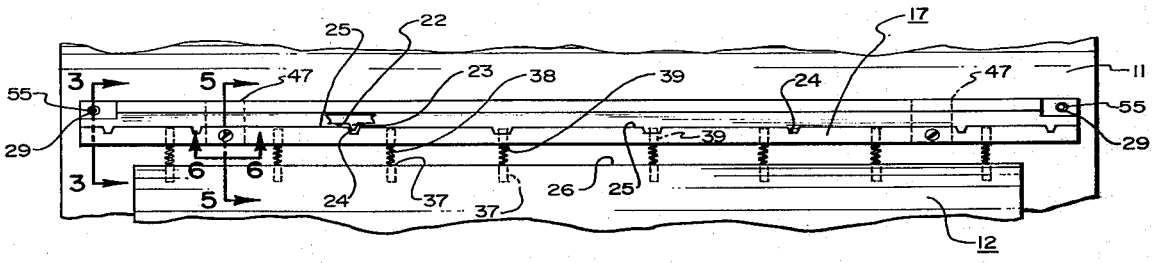
FIG. 2 is an enlarged, fragmentary, top plan of a portion of the structure of FIG. 1, illustrating the cooperation of the spring-loaded locking bar of the invention with the saddle of the press cylinder.

Of importance in the invention is the inclusion of an elongate locking bar 17, see in particular FIGS. 1 and 2. Locking bar 17, see also FIG. 3, includes a longitudinal angulated slot 18 that receives the downwardly and inwardly turned end 19 of a conventional plastic or metal-backed plastic printing plate 20. These plates in their construction form no part of the present invention of themselves alone, nor does the locking means 21 of which shaft 13 and cam lock 14 form representative respective parts.

These printing plates 20 will include, at inwardly turned edge 22, a series of protuberances 23. These protuberances will fit into notches or recesses 24 associated with proximate edge 25 of the slot which is nearest edge 26 of saddle 12.

Figure 3:
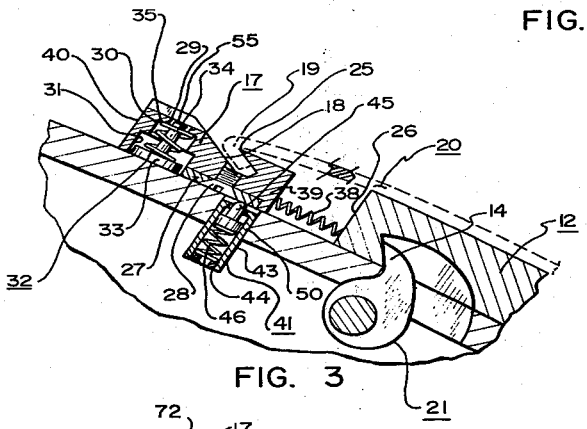
FIG. 3 is an enlarged, fragmentary, vertical section taken along the line 3—3 in FIG. 1, typical at opposite ends of the locking bar, and is rotated slightly in a counterclockwise direction, for convenience of illustration.
Figure 4:
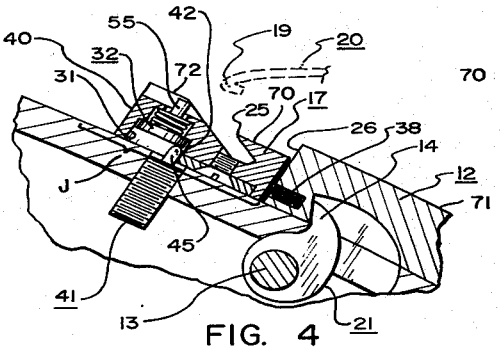
FIG. 4 is similar to FIG. 3 but illustrates the locking bar as being retained proximate the associated edge of the saddle.

One or more hardened steel plates or pads 27 are secured by countersunk machine screw 28 to the locking bar 17. As shown in FIGS. 3 and 4, the bottom surface of the composite locking bar 17 and the outer surface of the cylinder member 11 form a common slide surface juncture J.

Locking bar 17 includes concentric bores 29, and 30 and 31, which individually receive a spring-loaded plunger 32, the same being composed of plunger member 33 and compression spring 34 which abuts against shoulder 35

The upper edge 26 of saddle 12 is provided with a series of recessed bores 37 that receive, respectively, a series of compression srings 38. These are bottomed-end for recesses 39 of elongate locking bar 17. Accordingly, the compression springs 38 operate in tandem to push away, in effect, the elongate locking bar 17 relative to the forward edge 26 of saddle 12, gthereby applying a mount-tension to printing plate 20.

Where the printing plate is to be removed in the manner shown in FIG. 4, then the forward 40 edge of the locking bar, such edge 40 being aligned as shown with the thickness dimensions of the locking bar, is simply depressed in a direction downwardly to the left in FIG. 3, see FIG. 4, wherein detent 41 engages edge 42 of bore 31. FIGS. 3 and 4 illustrate that the detent 41 is comprised of an exteriorly threaded cylinder 43 having threaded or spot-welded base 44, by way of example. This edge may be crimped, if desired. Plunger 45 has an inverted-tee shape and is backed by compression spring 46. Accordingly, in an operaion as to this structure of the invention, when the locking bar is depressed downwardly and to the right, from the condition shown in FIG. 3 to that shown in FIG. 4, then plunger 45 will protrude upwardly in the manner shown in FIG. 4 so as to lock the locking bar 17 in proximity with edge 26 of saddle 12.

Figure 5:
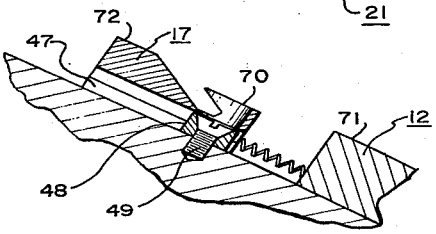
FIG. 5 is likewise an enlaged fragmentary vertical section taken along the line 5—5 in FIG. 2, is correspondingly rotationally displaced as in the case of FIG. 3, and illustrates the advance to the left of the locking bar relative to the drum saddle.
Figure 6:
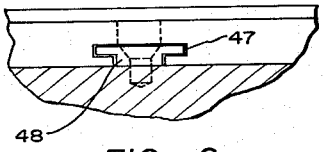
FIG. 6 is an enlaged fragmentary section as taken along the line 6—6 in FIG. 2, showing the intercooperation of the tee and tee slot structure of the apparatus.

FIGS. 5 and 6 illustrate certain tee slot structure, wherein a tee slot or undercut slot means 47 is transversely provided the locking bar at at least two places, see FIS. 1 and 6, with representative tee or headed guide protrusion 48, shown in FIGS. 5 and 6, being secured in place against cylinder member 11 by countersunk machine screw 49. This structure will occur at each of two places as is shown by the dotted line configurements at 47 in FIG. 2.

The structure as thus far described operates as follows:

The newspaper press drum or cylinder 10 will initially be provided with raised saddle 12, generally one on each side of the cylinder, and as indicated in FIG. 1. In the case of the present invention the saddle edge at 26 will be pre-drilled to supply a series of bore recesses at 37 for receiving compression springs 39.

The elongate locking bar 17 will be formed in the manner shown in FIGS. 2 and 3, the same having a proximate edge 25 which is provided with a series of notches 24 accommodating protrusions or pins 23 of plate edge 22.

Figure 11:
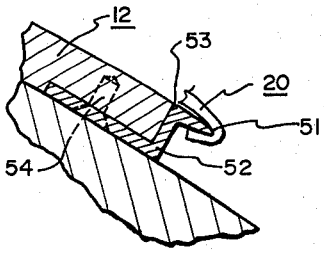
FIG. 11 is an enlarged, fragmentary section taken along the line 11—11 in FIG. 1, illustrating an elongate retainer bar having a Z-configured cross-section and secured to the rear or reverse edge of the saddle at the drum.

Threaded into aperture 50 is the cylinder 43 accommodating plunger 45. Thus, preparatory to locking of a plate in place, the elongate locking bar 17 will be returned and retained in place by plunger 45 in the manner shown in FIG. 4. A printing plate 20 will be provided and hooked over the trailing edge 51 of retainer bar 52, see FIG. 11. It is noted that this retainer bar is secured to the reverse edge 53 of the saddle 12 and is secured in place by machine screws 54.

The descent of the locking bar, i.e. closure of the locking bar relative to the saddle may be accomplished by conventional hand tools such as a hook, screw driver, and the like, to return the locking bar 17 proximate edge 26 of saddle 12 as shown in FIG. 4. At this point the forward, turned edge 19 of plate 20 is inserted over edge 25 such that the protuberances or pins of the plate at 23 engage notches 24 in edge 25.

At this point, the upstanding pins 55 of plungers 32 are depressed at opposite ends of the locking bar so as to depress plungers 45 and thereby permit the locking bar to advance upwardly and to the left as in FIG. 3 so as to apply tension via springs 38 and thereby mount printing plate 20.

A return of the locking bar as by urging the same downwardly and to the left, by hand or by any conventional tool, will enable a detent lock at 45, see FIG. 4, so that the printing plate can be replaced.

Figure 7:
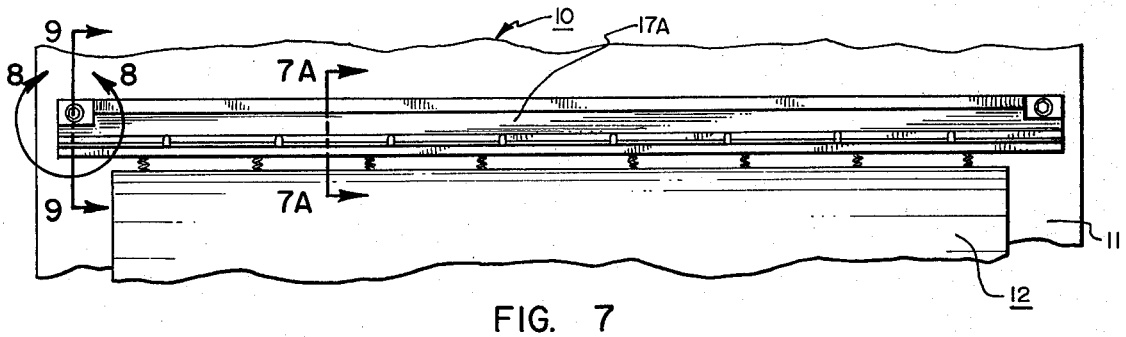
FIG. 7 is an enlaged fragmentary view similar to FIG. 2 but illustrates an alternate type of locking bar construction, wherein the same is provided with retainer pins for retaining a printing plate at its edge margin apertures.
Figure 7A:
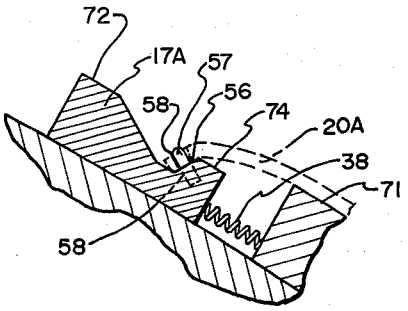
FIG. 7A is an enlarged fragmentary section taken along the line 7A—7A in FIG. 7.

FIGS. 7 and 7A illustrate an optional locking bar construction of the invention wherein this time the locking bar 17A, corresponding to locking bar 17 in FIGS. 1 and 2, is now provided with a forward surface provided with a series of pins 57. These pins may be fitted into and pressed into bore recesses 58 that may be drilled by conventional end mill. Printing plate 20A, corresponding to cutting plate 20 in FIG. 2, is this time provided with a series of end holes 58 that accommodate the reception of positioning pins 57. Accordingly, when the locking bar 17A is in a retracted position as shown in FIG. 4, then the printing plate may be positioned over the retainer bar 52 in the manner seen in FIG. 11 and then engage the pins 57 as shown in FIG. 7A. When the detent is released from the position shown in FIG. 4 to that seen in FIG. 3, then tension will be applied by compression springs 38 so as to apply a tensioning force to plate 20A.

Figure 8:
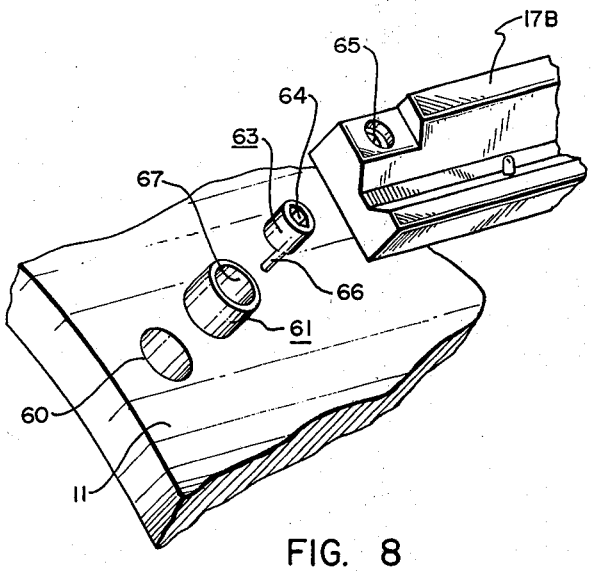
FIG. 8 is a fragmentary exploded view, is shown in perspective, and is an exploded detail of the structure of FIG. 7, being taken long the arcuate line 8—8 therein.
Figure 9:
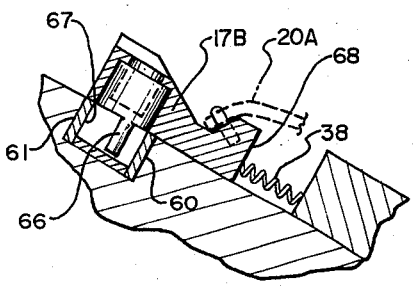
FIG. 9 is a fragmentary section taken along the line 9—9 in FIG. 7, showing the elongate locking bar as being disposed outwardly from the saddle, and illustrating the compression springs and associated structure that are employed to tension the printing plate, i.e. by thrusting outwardly against the elongate locking bar relative to the adjacent edge of the saddle.
Figure 10:
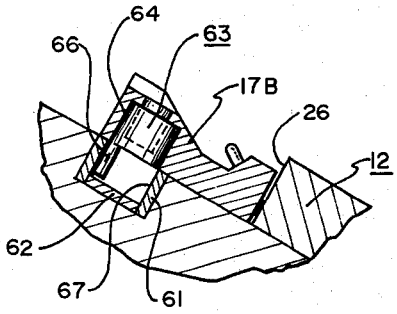
FIG. 10 is similar to FIG. 9 but illustrates the cam structure at opposite ends of the elongate locking bars being actuated so as to urge the locking bar inwardly toward the saddle and thereby permit a removal of the printing plate from the locking bar.

FIGS. 8, 9 and 10 illustrate another embodiment of the invention wherein, in lieu of a tool being used simply to press downwardly upon the bar 17 or 17A, a camming construction is provided. Thus, cylinder member 11 includes opposing side apertures 60 which receive bushings 61. These bushings may be provided with a welded or soldered base 62 as shown in FIG. 10. A cylindrical cam 63 has an Allen wrench, polygonal opening 64, which is designed to receive a conventional Allen wrench for rotational purposes. This cam member 63 is fitted into aperture 65 and includes a depending finger 66 that engages side wall 67 of bushing 61. Accordingly, what is provided in the structure of FIGS. 8–10 is a camming arrangement, wherein, by means of Allen wrences at opposite sides of the locking bar structure, the opposite-end camming structures may be turned so that when the finger 66 is in an uppermost positon, see FIG. 10, the locking bar is drawn in proximity with upper edge 26 of saddle 12. When, however, the cam member 63 is rotated so that the finger protrudes downwardly, see FIG. 9, then the action of springs 38 will be to press outwardly and upwardly against lower surfaces 68 of locking bar 17B, corresponding to locking bars at 17 and 17A, whereby to permit springs 38 to apply tension to locking bar 17B. Thus, FIG. 9 illustrates the tension condition of the plate wherein the cam finger has been released from engagement with bushing wall 67, and FIG. 10 illustrates the locking-bar retraction condition wherein the cam finger 66 now engages upwardly the inner side wall or surface 67 of bushing 61.

What is provided, therefore, is a new and improved structure for securing printing plates to press cylinders over the raised saddles thereof. The primary feature of the invetion is the spring-loaded locking bar which retentively releasably engages under spring tension a forward, upper edge of the printing plate while the remaining edge thereof is hooked or engaged to the saddle proper or preferably to the Z-configured retainer bar of FIG. 11.

Surface 70 should be disposed beneath the upper surface 71 of the saddle, both being outwardly spaced with respect to cylinder member 11. Nonetheless, there may be provided a surface 72 that would be raised so as to preclude an extension of pins 55 above the flat surface of the locking bar at 72. See FIG. 7A and FIG. 4.

It will be understood that saddle 12 may in fact comprise a raised integral portion of cylinder member 11 rather than be a separate part. The terms "member" and "portion" may be understood to be synonomous in this regard. The resilient means at 39, as before mentioned, may comprise any type of resilient agent suitable for springingly urging the locking bar 17 away from edge 26 of the saddle. It is finally to be understood, that by the present invention, workman may both load and unload a printing plate relative to the saddle without the requirement of rotation of cylinder 10.

While paticular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. In a printing press cylinder having an axial shaft, a cylinder member surrounding said shaft and keyed thereto for revolvement therewith, and a raised saddle disposed over and carried by said cylinder member and having an edge parallel to said shaft, an improvement comprising an elongate, printing-plate retaining locking bar disposed at a common slide surface juncture on and over a portion of said cylinder member parallel to said shaft and saddle edge and urgeable toward said saddle edge, said locking bar having a thickness dimension disposed along a radius of said cylinder member and also self-contained means for releasably retaining a printing plate end margin, resilient means for springingly urging said locking bar outwardly from said saddle edge to tension an external printing plate when mounted on said locking bar, and radially-outwardly-accessible actuatable means interiorly received within said locking bar, movable parallel to said thickness dimension along said radius, extending into said cylinder, disposed transverse to said common slide surface juncture, and releasably intercoupling said cylinder member and said locking bar for releasably fixing the disposition of said locking bar in a predetermined retracted position relative to said saddle edge for printing plate removal.

2. The structure of claim 1 wherein said saddle edge and said locking bar each include plural recesses disposed in corresponding registry, said resilient means comprising plural compression springs disposed in corresponding ones of said recesses.

3. The structure of claim 1 wherein said locking bar includes a longitudinal elongate upper recess constructed to receive the turned edge margin of an external printing plate.

4. Structure according to claim 1 wherein said cylinder member and said elongate locking bar include mutually engageable respective means for keying the movement of said locking bar about the periphery of said cylinder member to movements normal to said saddle edge.

5. Structure according to claim 1 wherein said saddle includes a reverse edge remote to said parallel edge, said saddle being provided with an elongate retainer bar secured proximate said reverse edge and including a printing plate engagement portion extending laterally outwardly from said reverse edge.

6. Structure according to claim 1 wherein said elongate locking bar includes a transverse, spring-loaded plunger, said locking bar including an interior aperture contiguous with said cylinder member and receiving said plunger, and spring-biased detent means secured in said cylinder member and including an outwardly biased spring-loaded plunger element disposed for registry with said plunger of said elongate locking bar when the latter is positioned inwardly relative to said saddle edge, said spring-loaded plunger and said spring-biased detent means comprising, in combination, said actuatable means.

7. Structure according to claim 1 wherein said elongate locking bar includes a wear plate slidably engaging said cylinder member.

8. Structure according to claim 3 wherein said elongate recess has a transverse cross-section inclined away from said saddle edge.

9. Structure according to claim 3 wherein said elongate locking bar includes mutually spaced pin means proximate said elongate recess and constructed to receive the edge apertures of an external printing plate.

10. Structure according to claim 4 wherein said mutually engageable respective means comprises at least one undercut slot means and a headed guide protrusion slideably seated in said undercut slot means, respectively.

11. Structure according to claim 8 wherein said elongate recess is provided with an edge proximate said saddle edge and containing mutualy spaced registry notches constructed for cooperation with the registry protrusions of an external printing plate.

12. In combination, a press cylinder provided with a raised saddle having an edge, an elongate locking bar disposed over said cylinder and parallel to and spring-biased with respect to said edge, said elongate locking bar having a thickness dimension disposed in the same direction as a radius of said cylinder, said elongate locking bar including transverse end apertures aligned with said thickness dimension thereof, respective rotatable cam means disposed in said apertures of said locking bar, said cylinder member includng spaced indentations cooperable with and receiving said cam means for regulating the disposition of said elongate locking bar relative to said saddle in accordance with the rotative movements of said cam means.

13. In combination, a printing press cylinder having a central axis and provided with a raised saddle having a transverse edge parallel to said central axis; an elongate independent locking bar disposed on and movably secured to said cylinder in spaced parallel relationship with said saddle edge, said locking bar having a thickness dimension disposed along a radius of said cylinder; resilient means for springingly biasing said elongate locking bar in a direction away from said saddle; a printing plate secured over said saddle and releasably mounted to said elongate locking bar under the tension of said resilient means, and means permaently installed in at least one of said cylinder and said locking bar and extending into said cylinder and oriented parallel to said thickness dimension of said locking bar and along said radius for releasably securing said locking bar in a predetermined retracted relationship with respect to said saddle edge for releasing said printing plate from the mounting thereof onto said locking bar.

14. In combination, a printing press cylinder provided with a cylinder member and a raised saddle having an edge, said cylinder member having an outer cylindrical surface, said saddle having an upper surface arcuately raised over said cylinder member, an elongate locking bar disposed on said cylinder member, advanceable toward said saddle with respect to said edge thereof, and havng a thickness dimension disposed along a radius of said cylinder member, said elongate locking bar including a self-contained printing plate retaining means, means for retaining said elongate locking bar proximate said cylinder member, means interiorly received by said locking bar parallel to said thickness dimension thereof, disposed transverse to and penetrating said cylinder surface, and cooperble with said cylinder and said locking bar for releasably securing said locking bar such that such printing plate retaining edge of said elongate locking bar is releasably fixed in a predeterined position retracted toward and parallel to said edge of said saddle, and a printing plate releasably and retentively engaging said locking bar edge and secured to and stretching over said saddle, said elongate locking bar being provided with resilient means for biasing said locking bar away from said saddle to thereby tension said printing plate.

15. The combination of claim 14 wherein said elongate locking bar and saddle have respective surfaces that are outwardly spaced with respect to said cylinder member, said surface of said saddle extending outwardly beyond said surface of said locking bar.

* * * * *

UNITED STATES PATENT OFFICE
CERTIFICATE OF CORRECTION

Patent No. 3,994,224 Dated November 30, 1976

Inventor(s) GEORGE B. HILL

It is certified that error appears in the above-identified patent and that said Letters Patent are hereby corrected as shown below:

Col. 3, line 49, change "srings" to read --springs--;
Col. 3, line 53, change "gthereby" to read --thereby--;
Col. 3, line 56, delete "forward 40 edge" and substitute --forward edge 40--.
Col. 4, line 8, change "FIS." to read --FIGS.--
Col. 4, line 38, delete "screw" and substitute --screw- --.
Col. 4, line 57, after "surface" insert --56--;
Col. 4, line 60, after "by" insert --a--.
Col. 5, line 18, delete "wrences" and substitute --wrenches--;
Col. 5, line 39, delete "invetion" and substitute --invention--;
Col. 5, line 42, after "engaged" insert --either--.
Col. 7, Claim 12, line 24 (Claim line 10), change "includng" to read --including--;
Col. 8, Claim 13, line 1 (Claim line 12), change "permaently" to read --permanently--;
Col. 8 Claim 14, line 16 (Claim line 8), change "havng" to --having--.
Col. 8, Claim 14, line 23 (Claim line 15, change "cooperble" to read --cooperable--.

Signed and Sealed this

First Day of March 1977

[SEAL]

*Attest:*

RUTH C. MASON
*Attesting Officer*

C. MARSHALL DANN
*Commissioner of Patents and Trademarks*